US008876123B2

(12) United States Patent
Bradshaw

(10) Patent No.: US 8,876,123 B2
(45) Date of Patent: Nov. 4, 2014

(54) EXOSKELETON AND FOOTWEAR ATTACHMENT SYSTEM

(76) Inventor: Erik Gawain Bradshaw, Queenstown (NZ)

( * ) Notice: Subject to any disclaimer, the term of this patent is extended or adjusted under 35 U.S.C. 154(b) by 223 days.

(21) Appl. No.: 13/438,139

(22) Filed: Apr. 3, 2012

(65) Prior Publication Data

US 2012/0256381 A1 Oct. 11, 2012

Related U.S. Application Data

(60) Provisional application No. 61/471,887, filed on Apr. 5, 2011.

(51) Int. Cl.

| | |
|---|---|
| ***A43B 5/04*** | (2006.01) |
| ***A63C 9/02*** | (2012.01) |
| ***A63C 9/00*** | (2012.01) |
| ***A63C 1/04*** | (2006.01) |
| ***A63C 1/18*** | (2006.01) |
| ***A63C 10/08*** | (2012.01) |
| ***A63C 10/06*** | (2012.01) |
| *A63C 10/04* | (2012.01) |

(52) U.S. Cl.

CPC ..... *A63C 1/04* (2013.01); *A63C 2201/06* (2013.01); *A63C 10/045* (2013.01); *A63C 9/02* (2013.01); *A63C 9/002* (2013.01); *A63C 2203/06* (2013.01); *A63C 1/18* (2013.01); *A63C 10/08* (2013.01); *A63C 10/06* (2013.01)

USPC ..... 280/11.3; 36/122

(58) Field of Classification Search

CPC ..... A43C 15/06–15/068; A43B 5/0421; A63C 13/001; A63C 13/003; A63C 13/006

USPC ..... 280/11.3, 11.31, 11.36; 36/89, 36/122–125, 117.1–119.1

See application file for complete search history.

(56) References Cited

U.S. PATENT DOCUMENTS

| | | | | | |
|---|---|---|---|---|---|
| 919,118 | A | * | 4/1909 | Blacklook | 36/7.7 |
| 1,116,179 | A | * | 11/1914 | Blacklook | 36/7.7 |
| 2,673,743 | A | | 3/1954 | Gould | |
| 2,776,499 | A | * | 1/1957 | Giuntini | 36/135 |
| 3,060,600 | A | * | 10/1962 | Howe | 36/125 |
| 3,344,538 | A | * | 10/1967 | Massicotte | 36/125 |
| 3,747,235 | A | | 7/1973 | Post | |
| 3,822,491 | A | | 7/1974 | Rathmell | |
| 3,861,399 | A | * | 1/1975 | Huff | 36/181 |
| 4,032,172 | A | | 6/1977 | Pyzel et al. | |
| 4,176,459 | A | * | 12/1979 | Perser et al. | 33/515 |
| 4,249,321 | A | * | 2/1981 | Nagy | 36/72 B |

(Continued)

*Primary Examiner* — Hau Phan
*Assistant Examiner* — Jacob Meyer
(74) *Attorney, Agent, or Firm* — Young & Thompson

(57) ABSTRACT

An exoskeleton (E) for connecting footwear to sporting equipment. The exoskeleton has an underfoot base (7), an ankle cuff (3) connected to a heel portion of the underfoot base, a first restraining brace (2*a*) having an anterior end connected to the medial side of a forefoot portion of the underfoot base (7), and extending rearwardly and diagonally at least to the lateral side of the ankle cuff, and a second restraining brace (2*b*) having an anterior end connected to the lateral side of the forefoot portion of the underfoot base (7), and extending rearwardly and diagonally at least to the medial side of the ankle cuff. The first and second restraining braces (2*a*, 2*b*) are configured such that when an item of footwear is enclosed by the exoskeleton (E), the restraining braces extend over and support a portion of the item of footwear.

30 Claims, 13 Drawing Sheets

(56) References Cited

U.S. PATENT DOCUMENTS

| | | | | | |
|---|---|---|---|---|---|
| 4,302,890 | A | * | 12/1981 | Covell et al. | 36/7.6 |
| 4,353,172 | A | * | 10/1982 | Bryant | 36/7.6 |
| 4,420,895 | A | | 12/1983 | Baumann et al. | |
| 4,620,375 | A | * | 11/1986 | Wallace | 36/7.6 |
| 4,660,303 | A | * | 4/1987 | Courvoisier et al. | 36/117.9 |
| 4,768,805 | A | | 9/1988 | Graillat | |
| 4,836,572 | A | | 6/1989 | Pozzobon | |
| 4,901,454 | A | | 2/1990 | Walkhoff | |
| 4,909,531 | A | | 3/1990 | Graillat | |
| 4,910,883 | A | * | 3/1990 | Zock, Jr. | 36/7.6 |
| 4,955,149 | A | | 9/1990 | Ottieri | |
| 5,014,448 | A | * | 5/1991 | Perrone | 36/110 |
| 5,066,036 | A | | 11/1991 | Broughton | |
| 5,090,138 | A | | 2/1992 | Borden | |
| 5,338,053 | A | | 8/1994 | Hauglin | |
| 5,449,192 | A | | 9/1995 | Challande et al. | |
| 5,518,264 | A | | 5/1996 | Broughton | |
| D375,773 | S | | 11/1996 | Haughlin | |
| 5,727,808 | A | | 3/1998 | Broughton | |
| 5,740,621 | A | * | 4/1998 | Wing et al. | 36/122 |
| 5,784,810 | A | | 7/1998 | Bonaventure | |
| 5,794,963 | A | | 8/1998 | Girard | |
| 5,815,953 | A | | 10/1998 | Kaufman et al. | |
| 5,823,563 | A | | 10/1998 | Dubuque | |
| 5,836,090 | A | * | 11/1998 | Smith | 36/7.6 |
| 5,894,684 | A | | 4/1999 | Sand et al. | |
| 5,897,127 | A | | 4/1999 | Hauglin | |
| 5,901,471 | A | * | 5/1999 | Warner | 36/124 |
| 5,924,719 | A | | 7/1999 | Girard | |
| 5,937,546 | A | | 8/1999 | Messmer | |
| 5,947,507 | A | | 9/1999 | Quintana et al. | |
| 5,957,478 | A | | 9/1999 | Vigny | |
| 5,970,632 | A | * | 10/1999 | Watson | 36/122 |
| 6,017,050 | A | | 1/2000 | Girard | |
| D425,162 | S | | 5/2000 | Hauglin | |
| 6,168,172 | B1 | | 1/2001 | Meibock et al. | |
| 6,170,175 | B1 | * | 1/2001 | Funk | 36/89 |
| 6,185,846 | B1 | * | 2/2001 | Neidhardt, Jr. | 36/124 |
| 6,209,229 | B1 | | 4/2001 | Bourdeau | |
| 6,256,908 | B1 | * | 7/2001 | Warner | 36/124 |
| 6,322,095 | B1 | | 11/2001 | Wheeler | |
| 6,374,518 | B2 | * | 4/2002 | Warner | 36/124 |
| 6,406,040 | B1 | | 6/2002 | Thorne | |
| 6,409,204 | B1 | | 6/2002 | Ayliffe | |
| 6,481,121 | B1 | * | 11/2002 | Tucker | 36/62 |
| 6,520,531 | B1 | | 2/2003 | Gien | |
| 6,648,364 | B2 | | 11/2003 | Okajima et al. | |
| 6,685,213 | B2 | | 2/2004 | Hauglin | |
| 6,691,434 | B1 | | 2/2004 | Couturier | |
| 6,742,286 | B2 | * | 6/2004 | Giovale | 36/7.6 |
| 6,810,607 | B2 | * | 11/2004 | Skrivan et al. | 36/59 R |
| 6,814,360 | B2 | * | 11/2004 | Kiniry et al. | 280/11.3 |
| 6,877,759 | B2 | | 4/2005 | Dandurand | |
| 6,889,997 | B2 | | 5/2005 | Okajima | |
| 6,964,118 | B2 | * | 11/2005 | Parisotto et al. | 36/7.6 |
| 7,089,688 | B2 | * | 8/2006 | Giovale | 36/7.6 |
| 7,178,821 | B2 | | 2/2007 | Miller et al. | |
| 7,472,497 | B2 | * | 1/2009 | Emerson et al. | 36/122 |
| 7,497,034 | B2 | * | 3/2009 | Emerson et al. | 36/124 |
| 7,509,757 | B2 | * | 3/2009 | Monsees et al. | 36/122 |
| 7,661,207 | B2 | * | 2/2010 | Monsees et al. | 36/122 |
| 7,681,905 | B2 | | 3/2010 | Hauglin | |
| 7,735,851 | B2 | * | 6/2010 | Shute et al. | 280/614 |
| 8,590,177 | B1 | * | 11/2013 | Quaeck | 36/59 R |
| 8,595,958 | B2 | * | 12/2013 | Chartrand et al. | 36/124 |
| 2001/0015023 | A1 | * | 8/2001 | Funk | 36/89 |
| 2002/0104234 | A1 | * | 8/2002 | Lancon et al. | 36/122 |
| 2002/0189133 | A1 | * | 12/2002 | Parisotto et al. | 36/7.6 |
| 2003/0037461 | A1 | * | 2/2003 | Petzl et al. | 36/7.6 |
| 2003/0101623 | A1 | * | 6/2003 | Settelmayer | 36/124 |
| 2003/0167657 | A1 | * | 9/2003 | Kiniry et al. | 36/125 |
| 2004/0148808 | A1 | * | 8/2004 | Okajima | 36/117.3 |
| 2006/0084899 | A1 | * | 4/2006 | Verkade et al. | 602/27 |
| 2006/0086006 | A1 | | 4/2006 | Forrest | |
| 2007/0045987 | A1 | * | 3/2007 | Shute et al. | 280/611 |
| 2007/0163154 | A1 | * | 7/2007 | Emerson et al. | 36/122 |
| 2007/0256331 | A1 | | 11/2007 | Narajowski et al. | |
| 2008/0047168 | A1 | | 2/2008 | Svensson | |
| 2008/0172908 | A1 | * | 7/2008 | Tatsuno | 36/124 |
| 2008/0184599 | A1 | * | 8/2008 | Ekberg | 36/117.3 |
| 2008/0287850 | A1 | | 11/2008 | Adarraga | |
| 2009/0179403 | A1 | * | 7/2009 | Ekberg | 280/623 |
| 2010/0307029 | A1 | * | 12/2010 | Chartrand et al. | 36/124 |
| 2012/0025479 | A1 | * | 2/2012 | Zeek | 280/11.31 |
| 2013/0180130 | A1 | * | 7/2013 | Giovale et al. | 36/62 |

* cited by examiner

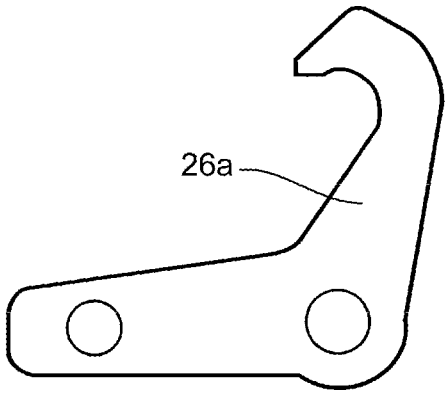
FIGURE 14
FIGURE 15
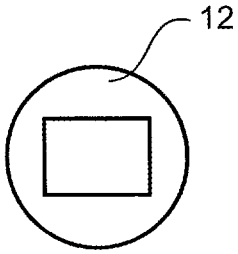

EXOSKELETON AND FOOTWEAR ATTACHMENT SYSTEM

FIELD OF THE INVENTION

This invention relates to an attachment system for attaching an item of footwear such as a standard walking or hiking boot or shoe for example to sports equipment such as a ski, snowboard, ice skate, inline skate or roller skate.

BACKGROUND

Footwear for sports such as skiing, snowboarding, mountaineering, or skating, is sport specific. Typically footwear for these sports is heavy, bulky, rigid and difficult to walk in, and only suitable for use in specific sporting applications.

For example, ski and mountaineering boots are typically made of stiff plastic to support the ankle and lower leg. Ski boots are designed for high lateral stiffness for precision and responsiveness when skiing, and mountaineering boots are stiff to facilitate crampon attachment and use. However, such stiff boots are difficult to walk in, heavy, and bulky, so mountaineers typically carry separate approach boots or shoes.

Snowboarding bindings typically use a support that encloses a boot with a soft upper. The support has a stiff base-plate which continues up the back of the ankle and lower leg to rigidly support the soft boot. Snowboarding boots may be stiff or flexible and are bulky so do not facilitate walking more than a short distance, or walking over steep or uneven terrain. Snow board boots and bindings are also heavy and bulky.

Ski-mountaineering and back-country or cross-country skiing combine the sport of skiing with hiking, trekking or mountaineering. In these pursuits, the skier needs to walk or climb to gain altitude without the assistance of chair lifts or tow ropes, and some travel, especially in an approach to a climb, may be over terrain that is not snow covered.

When a back-country skier or mountaineer reaches terrain that can't be traversed on skis, they must remove their skis and traverse that terrain by foot. If the terrain is covered by hard snow or ice, the skier will swap their skis for crampons. This typically involves removing their backpack, and sitting down to attach the crampons to their boots. If the slope is steep and icy, it may be difficult to find a safe place to do this, and a backpack resting on a sloped surface of hard snow or ice is at risk of sliding down the slope. Additionally, when the skier first steps out of their skis, the skier is at risk of slipping until they have fitted crampons.

By nature, ski-mountaineering and back-country skiing trips typically take place in remote, unpatrolled areas and may be multi-day trips, requiring the skier to carry camping gear in addition to equipment such as avalanche rescue gear and survival gear. Therefore, light weight compact gear is highly desirable in these pursuits.

Existing exoskeletons for attaching boots or other footwear to sporting equipment typically have rigid bases so are not suitable for walking. U.S. Pat. No. 6,691,434 describes an exoskeleton design having a rigid base. The rigidity of that system also relies on bracing extending up the back of the leg which makes the system bulky and heavy. Additionally, the system is designed to provide lateral tilting movement/tilting of the boot, which is undesirable for good ski control.

U.S. Pat. No. 5,815,953 and U.S. Pat. No. 4,955,149 also describe brace systems for attaching a walking boot to skis. Both of these systems have rigid soles with a hinge behind the heel to allow some ankle movement. Transverse, flexible straps secure the boot in place but provide little or no lateral stiffness. US 2008/047168 describes a brace that allows some flexure of the foot through the use of an underfoot hinge. This system is permanently secured to the item of sporting equipment and has no straps to retain a boot or shoe in place or to prevent movement of the footwear relative to the brace. This brace provides very little lateral support for the foot.

U.S. Pat. No. 5,823,563 describes a method of attaching 'crampons' to the front part of a ski boot and mounting the boot and crampon arrangement to skis. This system requires ski boots and is not suitable for use with standard walking boots. Additionally the 'crampons' in this system are only under the front part of the boot, and only have underfoot points with no heel or front points. Therefore, they would be of little practical use on hard snow or ice.

There is a need for an exoskeleton for attaching standard walking or hiking boots or shoes to sports equipment in a way that provides the necessary rigidity to the foot for the sporting pursuit, so a user can wear the same footwear for walking and with the sports equipment. It is desirable for such an attachment to be lightweight and easily dismantled or collapsed for storage or transport.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide an improved apparatus for attaching an item of footwear to sports equipment, or to at least provide the public with a useful choice.

SUMMARY OF THE INVENTION

In a first aspect of the invention an exoskeleton is provided for connecting an item of footwear to sporting equipment. The exoskeleton comprises: an underfoot base; an ankle cuff connected to a heel portion of the underfoot base; a first restraining brace having an anterior end connected to the medial side of a forefoot portion of the underfoot base, and extending rearwardly and diagonally at least to the lateral side of the ankle cuff to provide lateral support to the ankle cuff; and a second restraining brace having an anterior end connected to the lateral side of the forefoot portion of the underfoot base, and extending rearwardly and diagonally at least to the medial side of the ankle cuff to provide medial support to the ankle cuff. The first and second restraining braces are configured such that when an item of footwear is enclosed by the exoskeleton, the restraining braces extend over and support a portion of the item of footwear.

In an embodiment of the invention, the first and second restraining braces are sufficiently stiff to hold their shape in the absence of an external force. The first and second restraining braces may be substantially rigid.

In an embodiment of the invention, the first restraining brace comprises a posterior end positioned adjacent the lateral side of the ankle cuff, and the second restraining brace comprises a posterior end positioned adjacent the medial side of the ankle cuff. The exoskeleton may further comprise a restraining brace connector configured to extend behind the ankle cuff to operatively and detachably connect the posterior end of the first restraining brace to the posterior end of the second restraining brace. The restraining brace connector may be adjustable. For example, the restraining brace connector may be a ratchet strap arrangement.

The first restraining brace and the posterior end of the second restraining brace may be operatively and detachably connected to the ankle cuff and/or pivotally connected to the underfoot base. In an embodiment, the first and second restraining braces are removably connected to the underfoot base.

In an embodiment, the restraining braces comprise carbon fibre. The restraining braces may comprise a stiff or rigid material and a flexible material arranged so that if the stiff or rigid material undergoes a failure, the flexible material will keep the fractured parts connected.

The ankle cuff may be pivotally connected to the underfoot base and is preferably removably connected to the underfoot base. In an embodiment, the ankle cuff has a rear heel cut-out. The ankle cuff may comprise a relatively flexible posterior portion and relatively stiff lateral and medial portions.

In an embodiment of the invention the exoskeleton further comprises an adjustable cuff fastener connected to the ankle cuff, for securing the ankle cuff around the ankle of an item of footwear or around a user's lower leg enclosed in the exoskeleton. The adjustable cuff fastener may be a ratchet strap arrangement or other adjustable fastener or tie.

In an embodiment, the underfoot base has the form of a crampon. The base may comprise at least one crampon point at a periphery of the heel portion of the underfoot base and/or at least four crampon points disposed at the forefoot portion of the underfoot base. The base may optionally comprise at least two crampon points at each of a medial and lateral periphery of the forefoot portion of the underfoot base.

The ankle cuff and/or the restraining braces may further comprise connectors fixed to ends of the ankle cuff/restraining braces, for connecting the ankle cuff/restraining braces to the underfoot base. The connectors may comprise plates which form crampon points.

In an embodiment, the heel portion and the forefoot portion of the underfoot base are substantially rigid and connected by a relatively flexible mid-foot portion to allow vertical motion of the heel portion relative to the forefoot portion.

The exoskeleton may further comprise a flexible heel retaining strap and a flexible toe retaining strap.

The exoskeleton may further comprise an engagement feature for connecting the exoskeleton to an item of sporting equipment.

In a second aspect of the present invention there is provided a footwear attachment system for attaching an item of footwear to an item of sporting equipment. The system comprises: an exoskeleton as outlined above with respect to the first aspect and comprising an engagement feature for connecting the base to an item of sporting equipment; and a toe latch assembly attached to an item of sporting equipment, the toe latch assembly comprising at least one latch suitable for engaging the engagement feature on the exoskeleton.

In an embodiment of the invention, the latch and engagement feature are engaged, and the engagement forms a pivot for the exoskeleton so that the heel portion of the underfoot base is movable up and down with respect to the item of sporting equipment.

The attachment system may further comprise a secondary engagement feature on the forefoot portion of the underfoot base and a complementary secondary engagement feature on the toe latch assembly, wherein the complementary secondary engagement features are selectively engageable with each other to prevent the exoskeleton pivoting relative to the toe latch assembly.

In an embodiment, the base has the form of a crampon. The secondary engagement feature on the forefoot portion of the underfoot base may be provided in a crampon point.

The system may further comprise a heel latch assembly attached to the item of sporting equipment, wherein the heel latch assembly is selectively engageable with a heel engagement feature on the heel portion of the underfoot base.

In an embodiment, the pivot is positioned so that when a user's foot is secured in the system the pivot is under the user's big toe, providing a more natural walking movement than a pivot positioned forward of the toes.

The term "comprising" as used in this specification means "consisting at least in part of". When interpreting statements in this specification and claims which include the term "comprising", other features besides the features prefaced by this term in each statement can also be present. Related terms such as "comprise" and "comprised" are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Where specific integers are mentioned herein which have known equivalents in the art to which this invention relates, such known equivalents are deemed to be incorporated herein as if individually set forth.

As used herein the term "(s)" following a noun means the plural and/or singular form of that noun.

As used herein the term "and/or" means "and" or "or", or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which:

FIG. 14 is a side view of one of the latches in the toe latch assembly in FIG. 7;

FIG. 15 is the bush from the toe latch assembly in FIG. 7;

DETAILED DESCRIPTION OF A PREFERRED EMBODIMENT

In this description, the invention is described with reference to the attachment of walking boots to skis. It will be appreciated that other embodiments of this invention may similarly be used for attaching items of footwear such as boots or shoes to snowboards, ice skates, roller skates, inline skates, or other sporting equipment that is attached under a user's foot. Parts of the invention are described using the anatomical terms medial, lateral, anterior, posterior, superior and inferior, in reference to a user's foot or leg when the system is in use.

While the supporting figures and description relate to an apparatus for supporting a left-foot boot, it will be appreciated that the apparatus for supporting a right-foot boot will be provided with the same features, but in mirror image.

Figure 1:
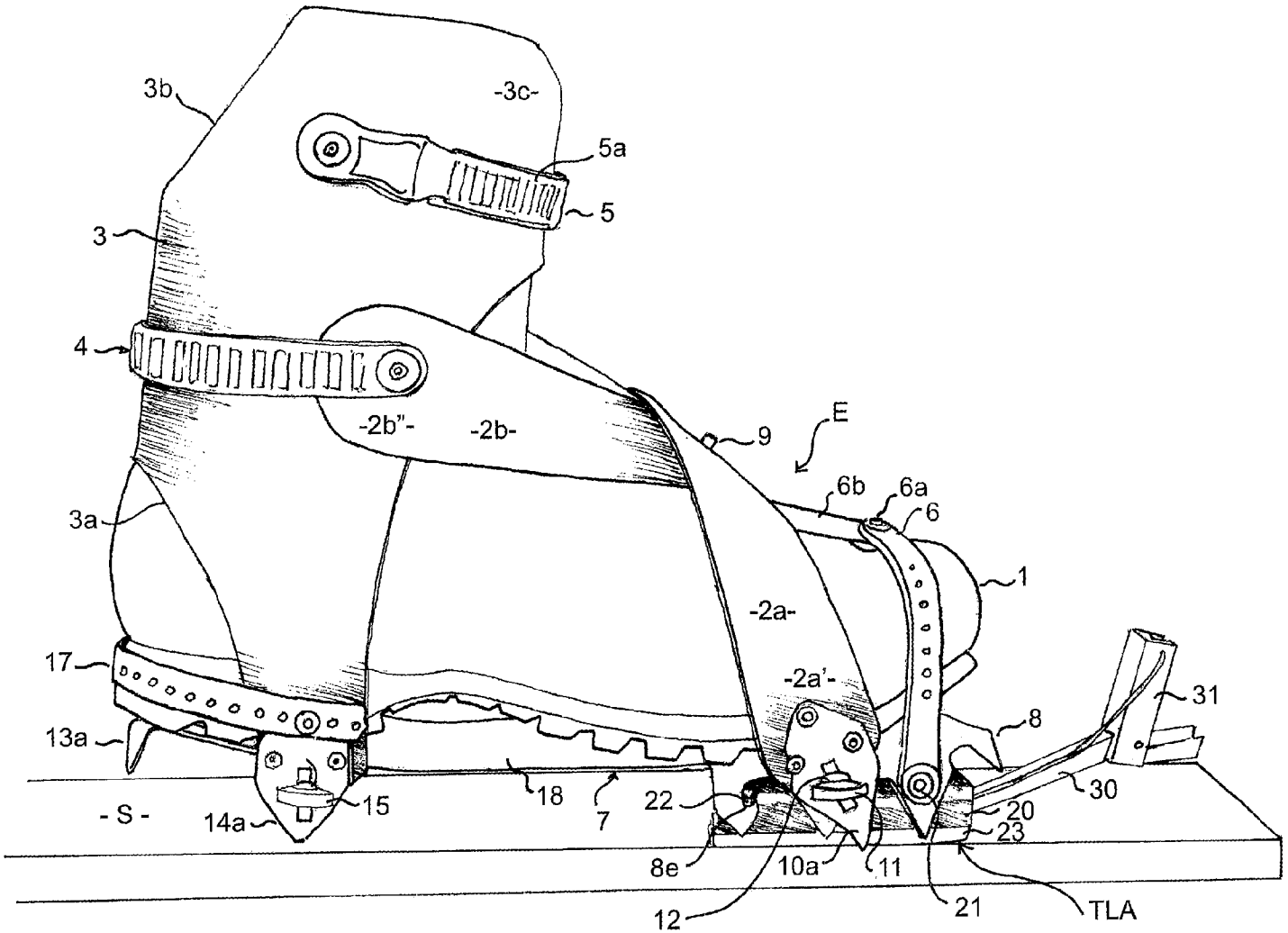
FIG. 1 is a side view of an embodiment of the invention, showing a left-foot walking boot enclosed in the exoskeleton and attached to a ski.
Figure 2:
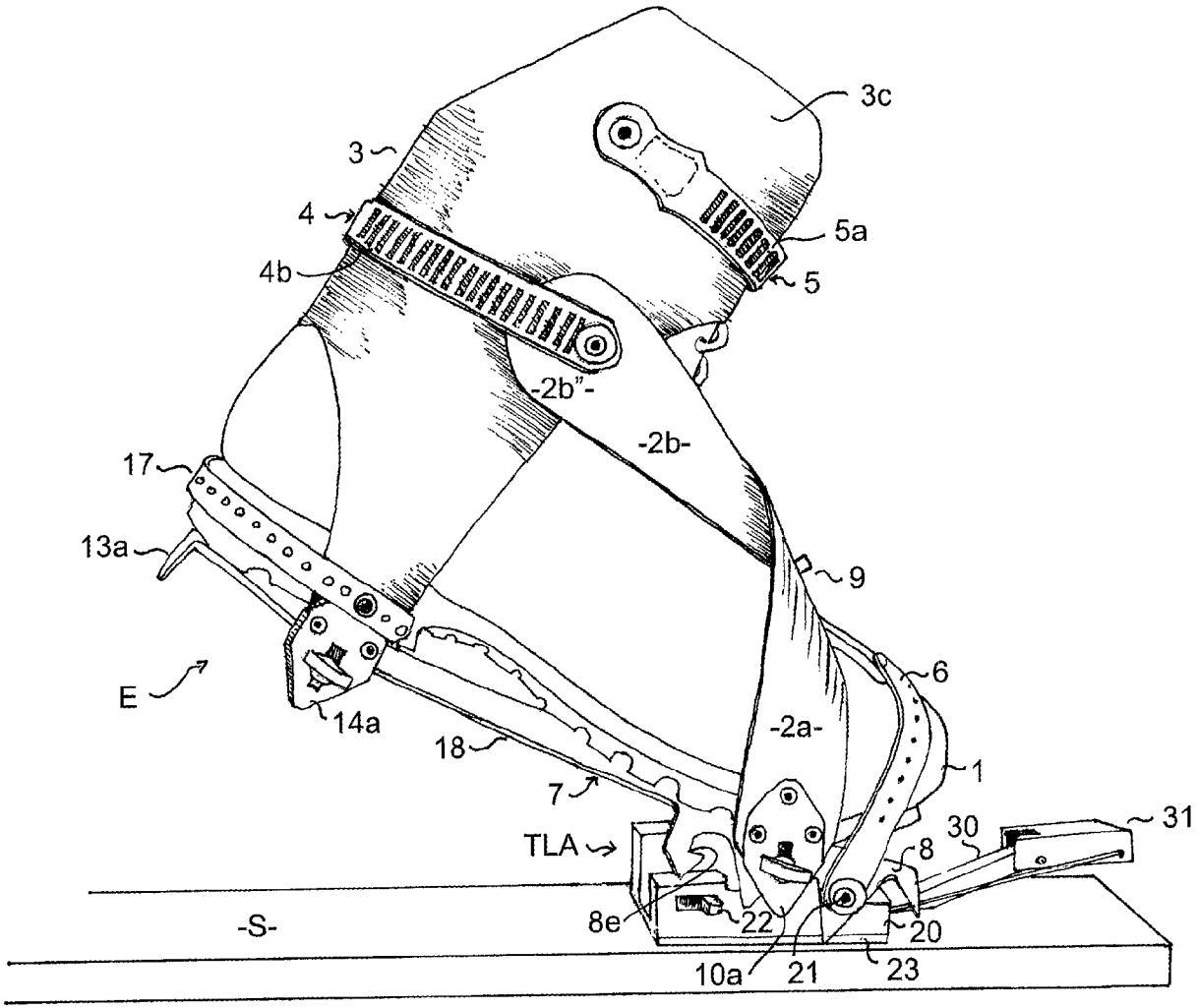
FIG. 2 is a side view of the embodiment of FIG. 1, showing a telemark-type connection between the exoskeleton and the ski, with the boot in a walking position.
Figure 3:
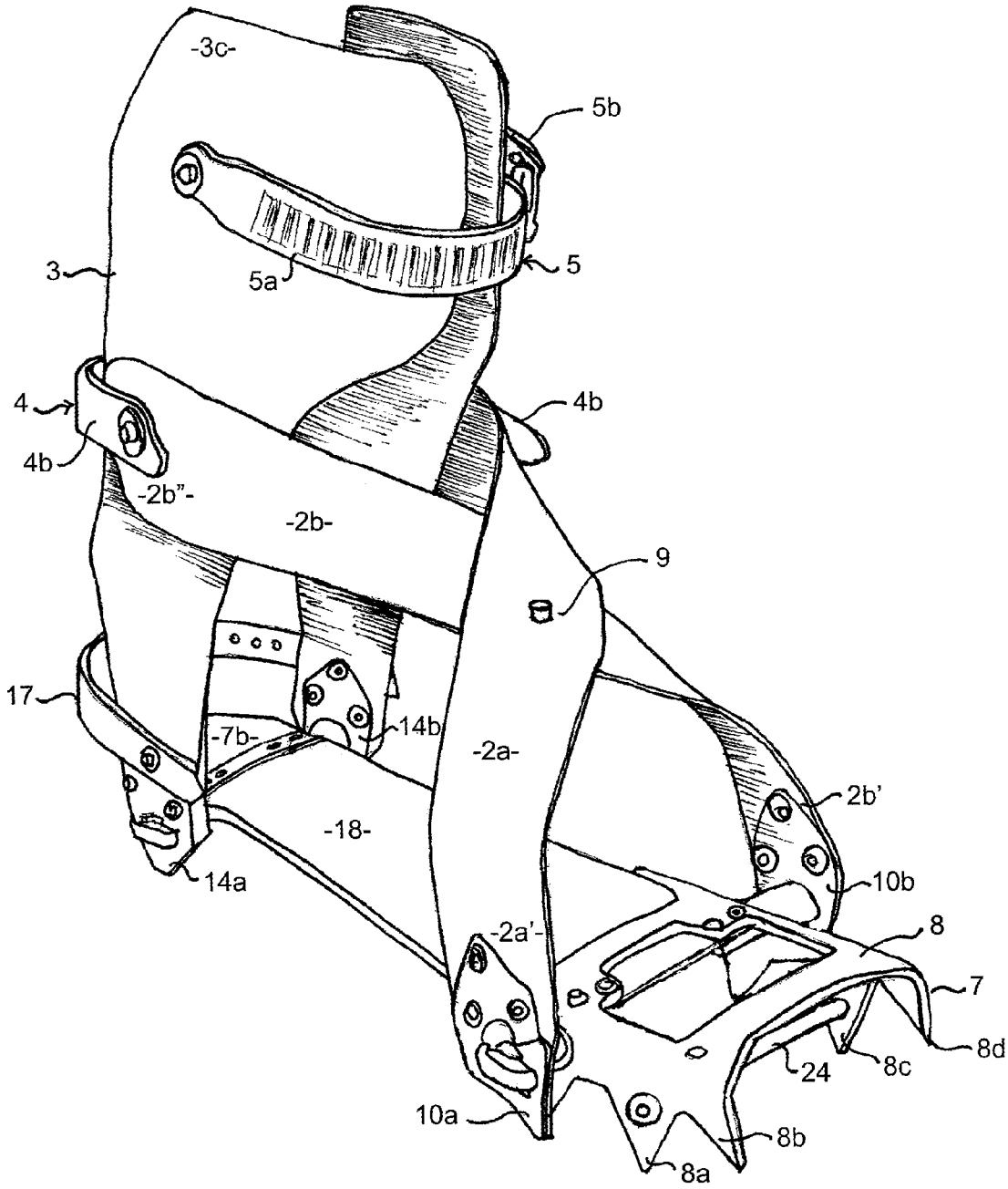
FIG. 3 is a perspective view of the exoskeleton without a boot, showing how the rigid restraining braces, ankle cuff and base assembly combine to form a structure that generally encloses the user's boot.

FIGS. 1 to 3 show a walking boot 1 attached to a ski S using a preferred embodiment footwear attachment system. The footwear attachment system comprises a toe latch assembly TLA fixed to the ski S or other sporting equipment, and an exoskeleton E removably attachable to the toe latch assembly TLA.

The exoskeleton E comprises first and second stiff restraining braces 2*a*, 2*b*, an ankle cuff 3, and a base 7. In the preferred embodiment the restraining braces 2*a*, 2*b*, ankle cuff 3, and base 7 are detachably coupled to each other. Alternatively, one or more of these pieces may be integral with another, for example the rigid restraining braces 2*a*, 2*b* may be a single component. In use, a user's boot is supported on top of the base 7, and the ankle cuff 3 and the restraining braces 2*a*, 2*b* fit over the boot to hold the boot and thereby a user's foot securely in place.

As shown in FIG. 3, the base 7 is in the form of an assembly having a forefoot portion 7*a*, a mid-foot portion 18, and a heel portion 7*b*. In a preferred embodiment, forefoot portion 7*a* comprises a rigid forefoot plate 8, the heel portion 7*b* comprises a rigid heel plate 13, and the mid-foot portion comprises a flexible underfoot plate 18 attached to the forefoot plate 8 and the heel plate 13. The mid-foot portion 18 has a relatively small vertical dimension and a relatively large transverse horizontal dimension, so that the mid-foot portion is vertically flexible but resists bending in the horizontal plane. This arrangement provides anterior-posterior flexibility of the base assembly 7, necessary for walking and telemark skiing, but prevents lateral movement of the heel relative to the toe to provide the lateral stiffness desirable for skiing and other sports.

In a preferred embodiment suitable for telemark skiing, the mid-foot portion may be made from plastic, for example 2 mm thick ultra high molecular weight polyethylene. For an embodiment suitable for downhill skiing the mid-foot portion could be relatively stiff, for example it may be made from aluminium. Alternatively, the mid portion may be substantially rigid.

In an alternative arrangement, the base 7 may be a single integrally formed component.

Each of the restraining braces 2*a*, 2*b* is an elongate strap-like member that has an anterior end 2*a*', 2*b*' and a posterior end 2*a*", 2*b*". The anterior end 2*a*', 2*b*' of each restraining brace is operatively connected to the forefoot portion 7*a* of the base member 7. The anterior end 2*a*' of the first restraining brace 2*a* is operatively connected to the medial side of the forefoot plate 8, and the anterior end of the second restraining brace 2*b* is operatively connected to the lateral side of the forefoot plate 8. Preferably the restraining braces 2*a*, 2*b* are connected to the forefoot portion 7*a* at points directly below and to the sides of the ball of the user's foot when the system is in use. In an alternative embodiment, the connection points could be higher, but aligned with the ball of the user's foot in a longitudinal direction of the user's foot.

The restraining braces are preferably stiff or substantially rigid and shaped or moulded to fit over a walking or hiking boot 1. The braces 2*a*, 2*b* are shaped so they are curved around both their longitudinal and transverse axes in a generally helical manner, and extend diagonally rearwardly from their connection at the forefoot plate 8, over the top of the boot to the opposite side of the ankle, so that the first and second restraining braces crossing each other above the mid-part of the foot. By curving around both their longitudinal and transverse axes, the inner surface of each brace can stay in close proximity to, and preferably contact, the top of the item of footwear over a substantial part of their lengths.

The first restraining brace 2*a* extends rearwardly and diagonally from its anterior end to at least the lateral side of the ankle cuff 3 to provide lateral support to the ankle cuff, and thereby to a boot and a user's foot/lower leg when using the apparatus. The second restraining brace 2*b* extends rearwardly and diagonally from its anterior end to at least the medial side of the ankle cuff 3 to provide medial support to the ankle cuff, and thereby to a boot and a user's foot/lower leg when using the apparatus. The posterior end 2*a*" of the first restraining brace 2*a* is positioned on the lateral side of the ankle brace 3 and the posterior end 2*b*" of the second restraining brace 2*b* is positioned on the medial side of the ankle cuff 3 opposite the posterior end of the first restraining brace 2*a* and preferably in line with or slightly above a user's ankle bone (lateral and medial malleolus).

Preferably the restraining braces are made from a material with a high strength-to-weight ratio that is shapeable during manufacture, and that enables the braces to maintain their shapes (in the absence of an external force) when the boot is removed, and they are not easily substantially deformed by the application of external force. In a preferred embodiment, the restraining braces are carbon fibre. Alternatively the restraining braces could be an aramid fibre laminate, fibreglass, another composite, or a metal such as spring steel. In an embodiment having metal restraining braces, the restraining braces may have a plastic coating for comfort and corrosion and wear protection. Preferably the straps are made from a material having a Young's modulus over 100 GPa and/or have a theoretical (untwisted) cantilever stiffness greater than 500 $Nm^{-1}$ and more preferably greater than 1500 $Nm^{-1}$.

Preferably the rigid restraining braces 2*a*, 2*b* further comprise a flexible or ductile material. It would be undesirable for the restraining braces to undergo brittle failure, particularly at altitude on a mountain. Inclusion of a flexible component in the restraining braces would ensure that if the braces suffered a brittle fracture, they would still remain in one piece. For example, in a preferred embodiment the rigid restraining braces are made from tubular weave carbon fibre with a flexible core from a material such as polyolefin fibre, aramid fibre, or polypropylene fabric tape. A similar configuration could be used for the ankle cuff 3.

In a preferred embodiment, the posterior ends 2*a*", 2*b*" of the first and second restraining braces 2*a*, 2*b* are detachably connected to each other via an attachment system 4 comprising a fastener 4*a* and an adjustable strap 4*b* that extends behind the ankle cuff 3. The attachment system is preferably a ratchet-type system, with a first end of the strap 4*b* fixed to the posterior end 2*b*" of the second restraining brace 2*b* and the ratchet fastener 4*a* attached to the posterior end 2*a*" of the first restraining brace 2*a*, so the fastener 4*a* is positioned on the lateral side of the ankle and is easy to reach by the user. Alternatively, the attachment system may comprise a buckle and strap, a cord or tie system, or other adjustable connection means.

In an alternative embodiment, the posterior ends 2*a*", 2*b*" of the restraining braces may be attached to the ankle cuff.

In another alternative embodiment, the posterior ends 2*a*", 2*b*" of the restraining braces could be positioned further rearward, and could curve around and support the ankle cuff from behind.

The first and second restraining braces 2*a*, 2*b* may be connected to each other at the point where they cross over. This stops the restraining braces moving relative to each other, improving the rigidity of the system. In the embodiment shown in the accompanying drawings, a post 9 projects upward from the second restraining brace 2*b* and fits through a corresponding aperture in the first restraining brace 2*a*, which crosses over the top of the second restraining brace.

The ankle cuff 3 is a one piece member that encloses the ankle and lower leg portion of the boot 1. The ankle cuff is operatively connected to the heel portion 7*b* of the base assembly 7 via a lateral connection and a medial connection. In a preferred embodiment, the ankle cuff has a cut out 3*a* behind the heel and a cut out 3*b* at the rear of the cuff above the ankle, to permit free movement of the Achilles tendon and the calf muscle. These cut outs reduce the weight of the ankle cuff 3, and the lower cut out ensures the ankle cuff 3 can be made from a flat piece of material and still achieve a good fit around the boot. The cut out above the ankle may not be necessary for some types of skiing or sports, and the upper cut out will not be present if greater calf stability is required.

The ankle cuff is laterally stiff to resist medial and lateral bending of the lower leg or ankle and thereby provide medial and lateral support to the lower leg and ankle. The ankle cuff 3 may be entirely or partly rigid, but preferably has some flexibility in the transverse plane so it can bend and be tightened around a user's ankle.

In a preferred embodiment the ankle cuff 3 is made from carbon fibre. Alternatively the cuff could be made from plastic, preferably a thermoset plastic or a high molecular weight thermoplastic such as ultra high molecular weight polyethylene, or another composite material with a high stiffness to weight ratio. For comfort, the ankle cuff 3 may have padding, for example closed cell foam, attached to at least part of the inside of the ankle cuff where the cuff fits directly over the ankle or lower leg rather than over the boot or shoe. More padding would be necessary in an ankle cuff to be worn with shoes than one for use with boots, which may require no padding or only some padding at the top of the ankle cuff 3.

Figure 9:
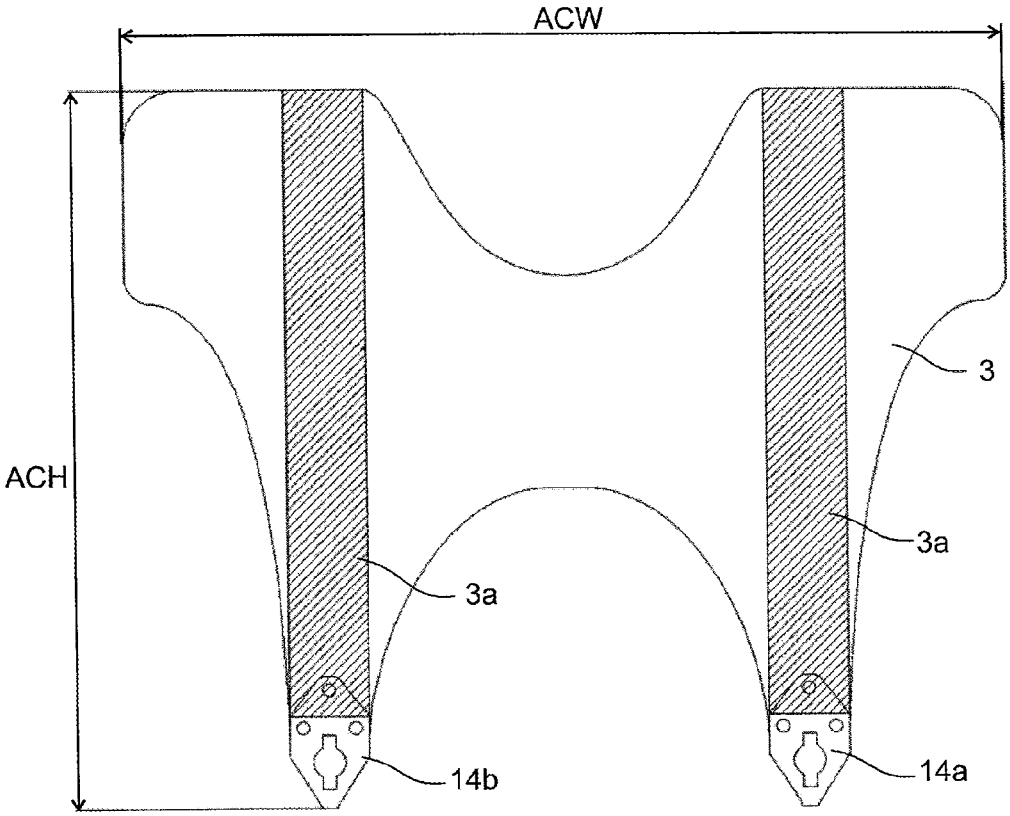
FIG. 9 is the blank of the ankle cuff of the embodiment of FIG. 1, with metal endplates attached.

FIG. 9 shows a blank of the ankle cuff 3 for a preferred embodiment. The main body of the cuff is flexible to allow the cuff to be bent around the user's foot. Integral stiffening panels 3*a* are present on the medial and lateral sides of the ankle cuff to provide lateral stiffness to the cuff and provide medial and lateral support to the lower leg and ankle. In a preferred embodiment the main body of the ankle cuff 3 comprises a carbon fibre or polyolefin fibre laminate bonded using a flexible resin, and the stiffening panels 3*a* comprise carbon fibre or nylon bonded using a stiff resin. The blank of the ankle cuff of shown in FIG. 9 has a height ACH of about 270 mm and a width ACW of about 330 mm. However, these dimensions are indicative only and may be varied.

An upper portion 3*c* of the ankle cuff above the ankle has at least one fastening arrangement for securing the cuff around the user's lower leg or ankle. In a preferred embodiment, the fastening arrangement is a ratchet strap 5 arrangement comprising a strap 5*a* fixed to the medial side of the cuff 3 and a complimentary ratchet fastener 5*b* fixed to the lateral side of the cuff 3. The fastening arrangement can be tightened to compress the ankle cuff 3 around the lower leg. Depending on the height of the ankle cuff, multiple fastening arrangements may be used for a more secure fit and to reduce the tension on each fastener.

The overall effect of the rigid restraining braces 2*a*, 2*b*, ankle cuff 3, and base 7 is to provide a three-dimensional structure that resists lateral movement and flexing of the boot and foot and user's foot and ankle but allows controlled forward flexing of the boot and foot. The first and second substantially rigid restraining braces are shaped such that when a boot is enclosed by the exoskeleton, the substantially rigid restraining braces extend over and support a portion of the boot.

Figure 17:
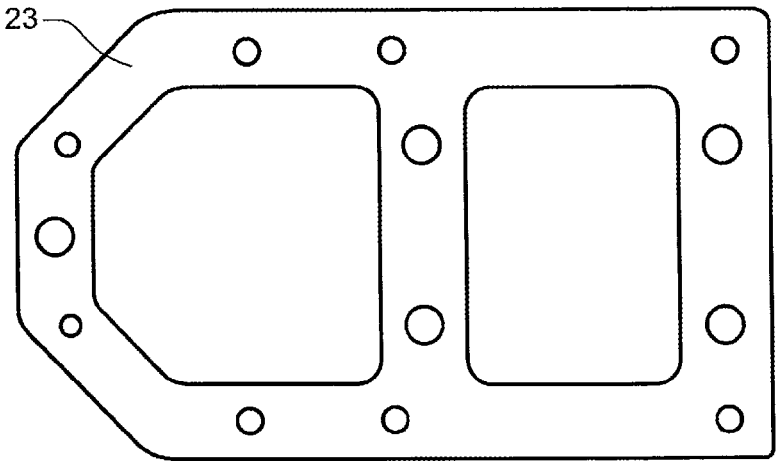
FIG. 17 is a plan view of the base plate of the toe latch assembly of FIG. 7.
Figure 18:
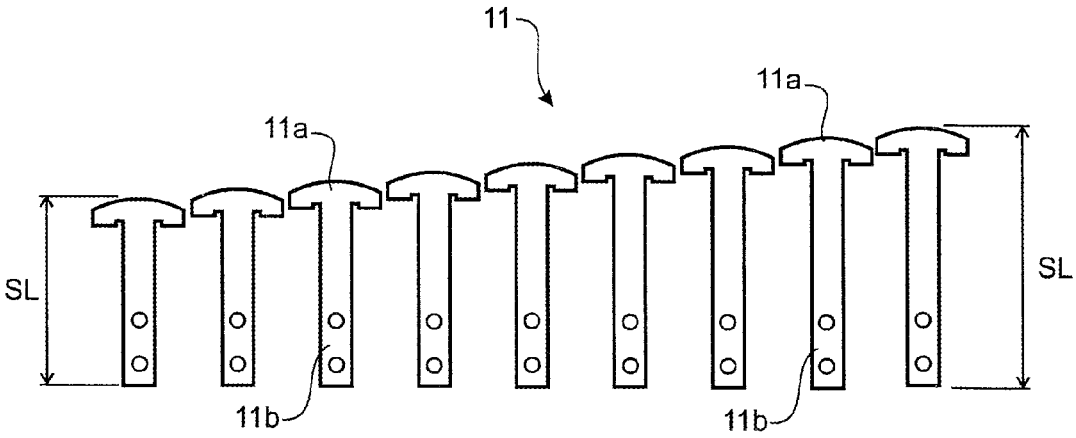
FIG. 18 shows a series of half turn connectors, each having different shank lengths for use with footwear of differing widths.
Figure 19:
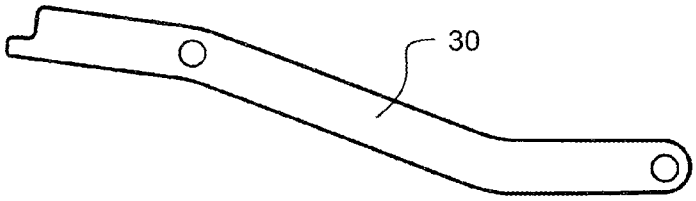
FIG. 19 is a side view of the lever of the toe latch assembly of FIG. 7.

FIGS. 9 to 19 show blanks for some components according to one working embodiment of the invention. The dimensions of the blanks may be varied for many reasons including to accommodate different types or size footwear, for use with different sporting equipment or for design reasons, without departing from the scope of the present invention. Some components preferably include features to give the arrangement some adjustability. For example, the flexible underfoot plate 18 has a series of apertures at both ends to provide a plurality of different positions for attaching the forefoot and heel portions to adjust the base to fit footwear of different lengths. FIG. 18 shows that the shank lengths the half turn connectors 11 may be varied, for example the length SL may be between about 42 mm to about 58 mm, depending on the width of a user's boots or shoes. Depending on the dimensions of the footwear, the length of the half-turn connectors in the forefoot portion 7*a* of the base may be different to the length of the half-turn connectors in the heel portion 7*b* of the base.

Flexible heel and toe straps may be used to help retain the boot 1 in the exoskeleton E and prevent the boot moving back or forward relative to the base assembly 7. In a preferred embodiment, a flexible retaining heel strap 17 is attached to an inferior part of the ankle cuff 3 on either side, near where the ankle cuff is connected to the base assembly 7. The flexible retaining heel strap 17 extends around behind the heel of the boot and prevents the boot 1 from overextending backward and distorting the back of the boot. In a preferred embodiment, a flexible retaining toe strap 6 is attached to the medial and lateral sides of the forefoot portion of the base by fasteners 21. A longitudinally extending retaining strap 6*b* connects the toe straps 6 at point 6*a* and to the rigid restraining braces 2*a*, 2*b* at the point where they cross. In the embodiment shown, the additional retaining strap 6*b* connects to the post 9 on the second restraining brace 2*b*.

Alternatively, the base assembly may be configured to fit hiking or trekking boots having heel and toe welts. In place of the flexible retaining heel and/or toe straps, the base assembly 1 could have a heel clamp and toe bail to engage with welts on the boot.

In a preferred embodiment, the ankle cuff 3 and the restraining braces 2*a*, 2*b* are connected to the base 7 via metal plates 10*a*, 10*b*, 14*a*, 14*b*, riveted to the respective ankle cuff or restraining brace. These metal plates strengthen the ankle cuff 3 and restraining braces 2 in the high stress areas where they are connected to the base 7.

In a preferred embodiment the base 7 of the exoskeleton E functions as a crampon when it is not attached to the ski via the toe latch assembly TLA. The heel plate 13 has at least one downwardly extending sharp projection 13*a* at its periphery. Each of the medial and lateral sides of the fore foot plate 8 has multiple downwardly extending sharp projections 8*a*, 8*b*, 8*c*, 8*d* and optionally the forefoot plate 8 may have front downwardly extending sharp projections. In the embodiment shown, the metal plates 10*a*, 10*b*, 14*a*, 14*b* on the ankle cuff 3 and the restraining braces 2*a*, 2*b* are shaped to form crampon points when the ankle cuff 3 and the restraining braces 2*a*, 2*b* are operably connected to the base 7.

Figure 10:
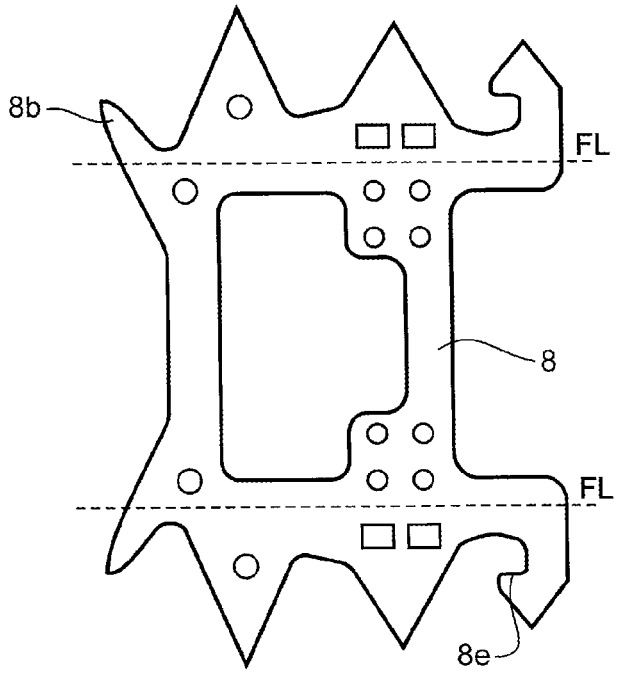
FIG. 10 is the sheet metal blank showing fold lines FL for forming the forefoot plate of the base in the embodiment of FIG. 1.
Figure 11:
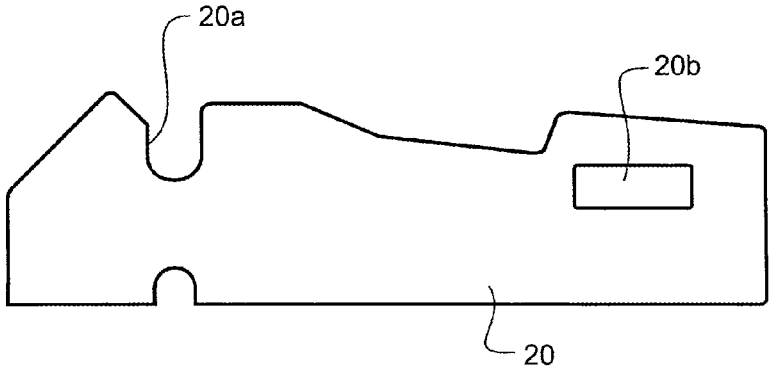
FIG. 11 is a side view of one of the supports in the toe latch assembly in FIG. 7.
Figure 12:
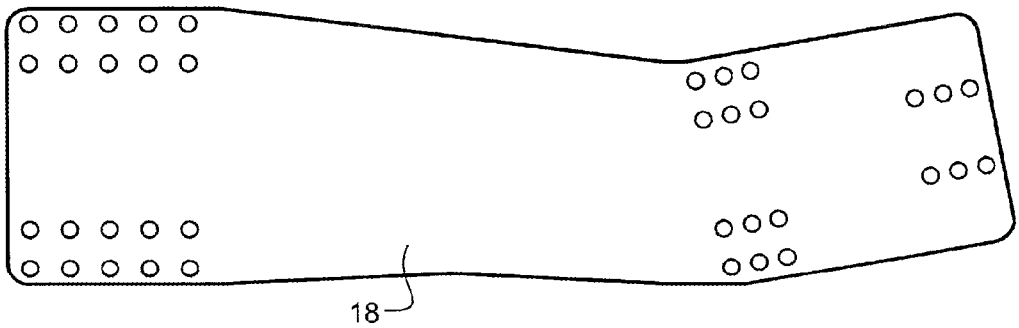
FIG. 12 is a plan view of the flexible underfoot plate forming the mid-foot portion of the base in the embodiment of FIG. 1.
Figure 13:
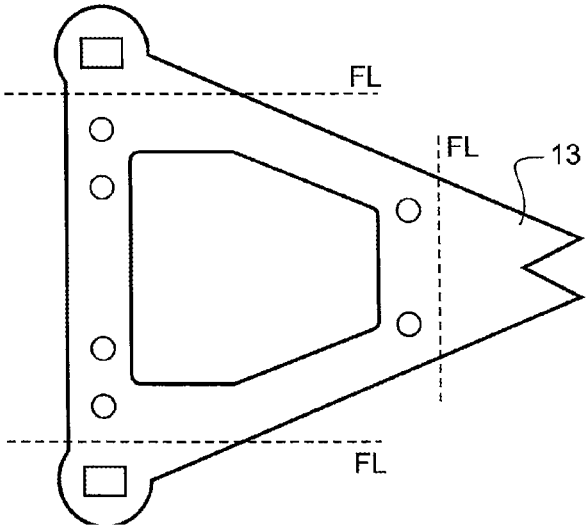
FIG. 13 is the sheet metal blank showing fold lines FL for forming the heel plate of the embodiment of FIG. 1.
Figure 16:
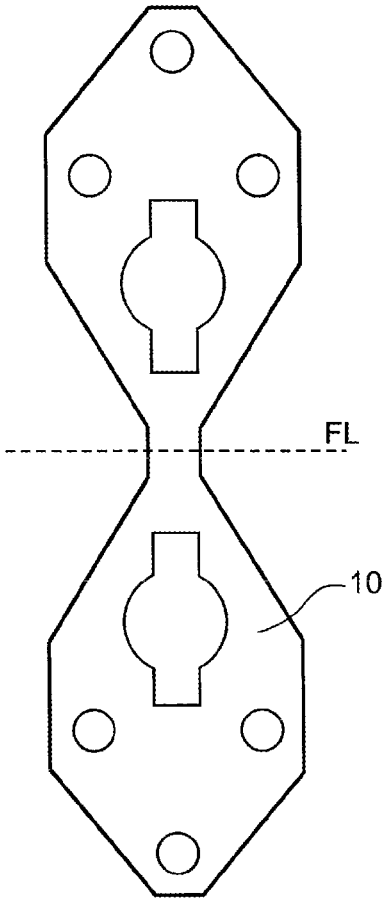
FIG. 16 is a sheet metal blank showing fold lines FL for forming the metal end plates that connect to the ankle cuff in the embodiment of FIGS. 1 and 9.
Figure 20:
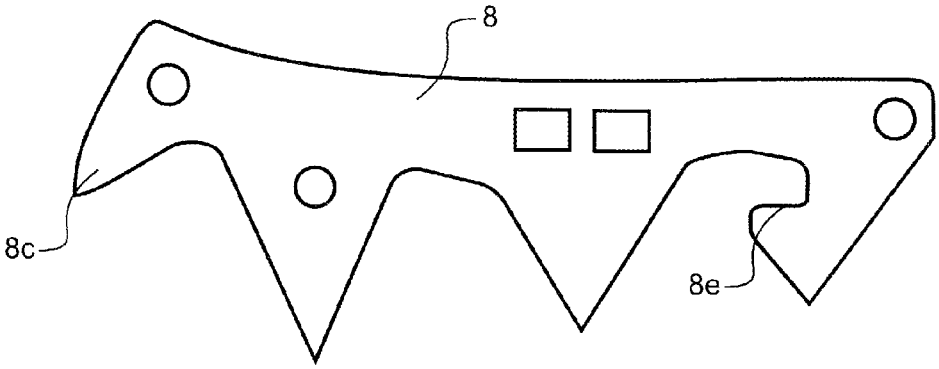
FIG. 20 is a side view of an alternative forefoot plate for use in an embodiment of the invention.

FIG. 10 shows a blank for forming the forefoot plate 8 in a preferred embodiment where the base 7 is in the form of a crampon. Alternatively, the forefoot plate could comprise a horizontal plate with two separate plates having crampon points connected at the sides. A side view of a forefoot plate 8 having this alternative arrangement is shown in FIG. 20.

Figure 5:
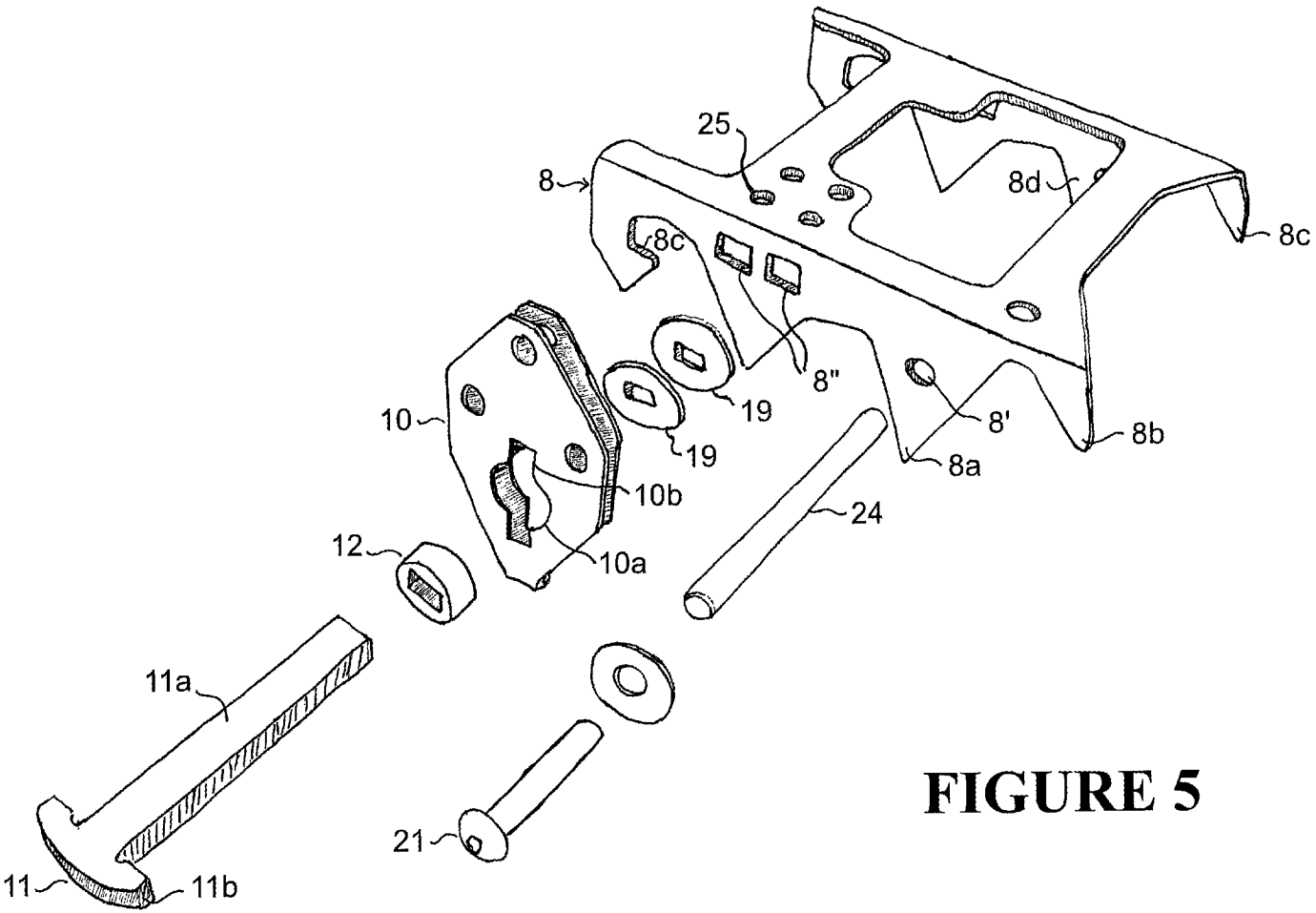
FIG. 5 is an exploded, perspective view of the forefoot portion of the base assembly of the exoskeleton.

FIG. 5 shows an exploded view of the forefoot portion 7*a* of the base 7 of the preferred embodiment. A pivot bar 24 and two half turn connectors 11 are attached underneath the forefoot plate 8 at either side, and located and supported in corresponding apertures 8', 8" in the crampon points. Pivot bar 24 is a cylindrical bar extending between medial and lateral sides of the forefoot plate and held in place via fasteners 21 such as machine screws. The half turn connectors 11 each have a shank 11*a* with a protruding head 11*b*, and both the head and the shank having a rectangular cross section. The half turn connectors 11 are positioned in corresponding rectangular apertures in opposite crampon points, preferably immediately below the ball of a user's foot when the system is in use. The shank of each half turn connector 11 is attached to the underside of the forefoot plate 8 via fasteners through apertures 25. In the embodiment shown in the accompanying drawings, the forefoot plate 8 contains two sets of rectangular fastener apertures 8" to provide two possible positions for the half turn connectors 11, so the user can position the half turn connectors 11 and thereby the restraining braces 2*a*, 2*b*, for the best fit.

In a preferred embodiment, the metal end plates 10*a*, 10*b*, fixed to the rigid restraining braces 2*a*, 2*b*, are pivotally mountable on the shank 11*a* of the half turn connectors 11 via a bush 12. This arrangement pivotally attaches the braces 2*a* to the forefoot portion 7*a* of the base 7. The metal end plates 10*a*, 10*b* have an aperture comprising an opening 10*a* with a diameter to fit the bush 12, and a rectangular slot 10*b* to fit the head of the half turn connectors 11. The end plates (and therefore the rigid restraining straps 2*a*, 2*b*) are removable from and connectable to the base assembly 7 by rotating the end plates 10*a*, 10*b* so the rectangular slot 10*b* aligns with the head 11*b* of the respective half turn connector 11, and sliding the endplate on or off the shank 11*a* and bush 12. The slot is oriented so it forms an angle with the head of the half turn connector 11 when the respective rigid restraining strap is positioned over a boot enclosed by the exoskeleton. In the embodiment shown in the figures, the slot 10*b* is oriented so it forms an angle of about 60 degrees with the head of the half turn connector 11 when the respective rigid restraining strap is positioned over a boot enclosed by the exoskeleton.

Figure 6:
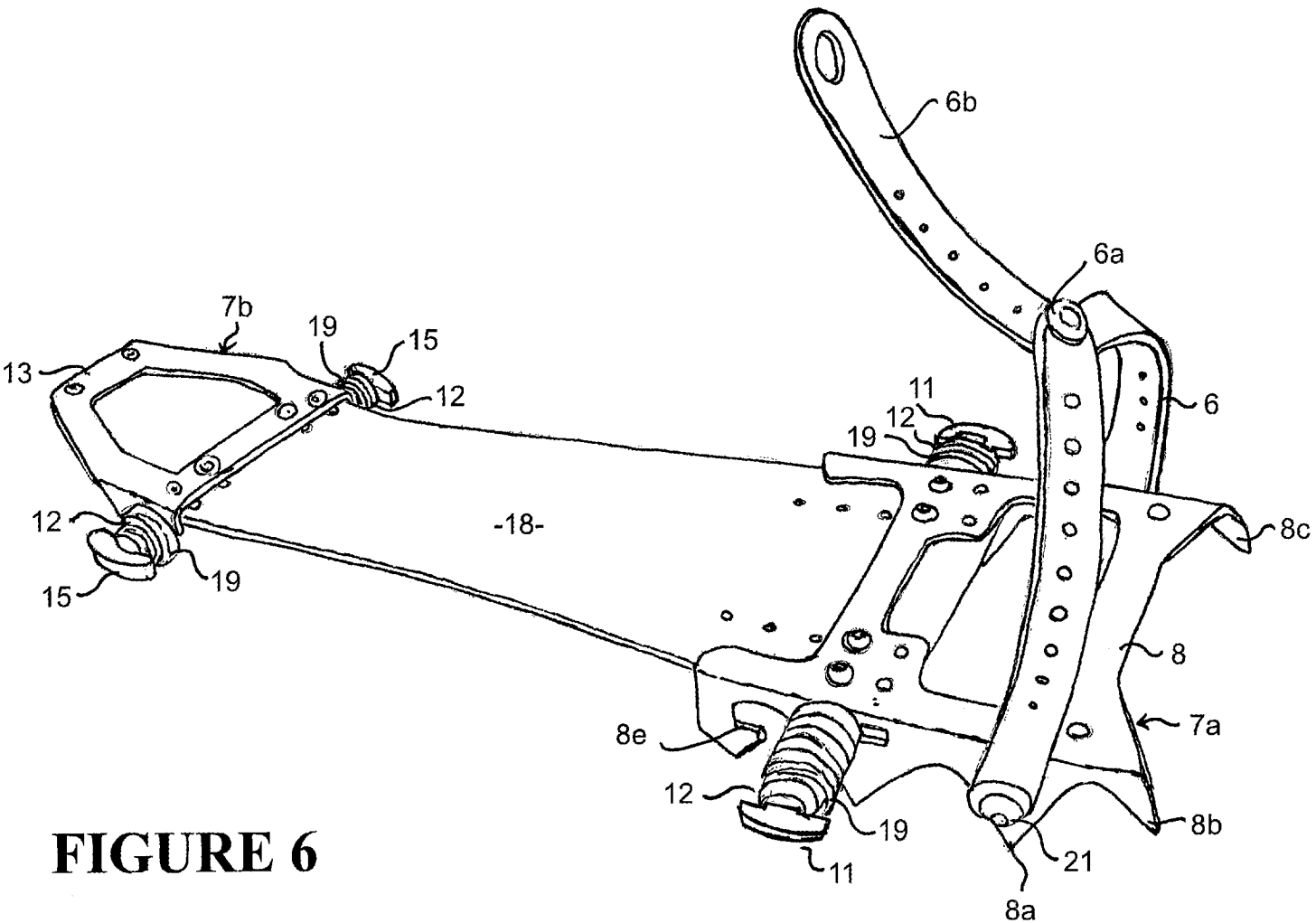
FIG. 6 shows the base assembly of the exoskeleton of a preferred embodiment, where the base assembly has the form of a crampon.

A similar connection is used in the heel portion 7*b* of the base 7 for removably and pivotally connecting the ankle cuff 3 to the base, as shown in FIGS. 3 and 6. Two half turn connectors 15 are attached to the underside of the heel plate 13. The metal cuff connection plates 14*a*, 14*b* have apertures similar to those in end plates 10*a*, 10*b*, so the ankle cuff can be attached by aligning and sliding the aperture over the head of the half turn connectors 15, and then rotating the ankle cuff to lock the cuff onto the half turn connectors 15.

As shown in FIG. 6, spacers or washers 19 may be placed between the sides of the forefoot or heel plate and the head of the respective connector to accommodate a boot that is wider than the heel or forefoot plate.

Figure 7:
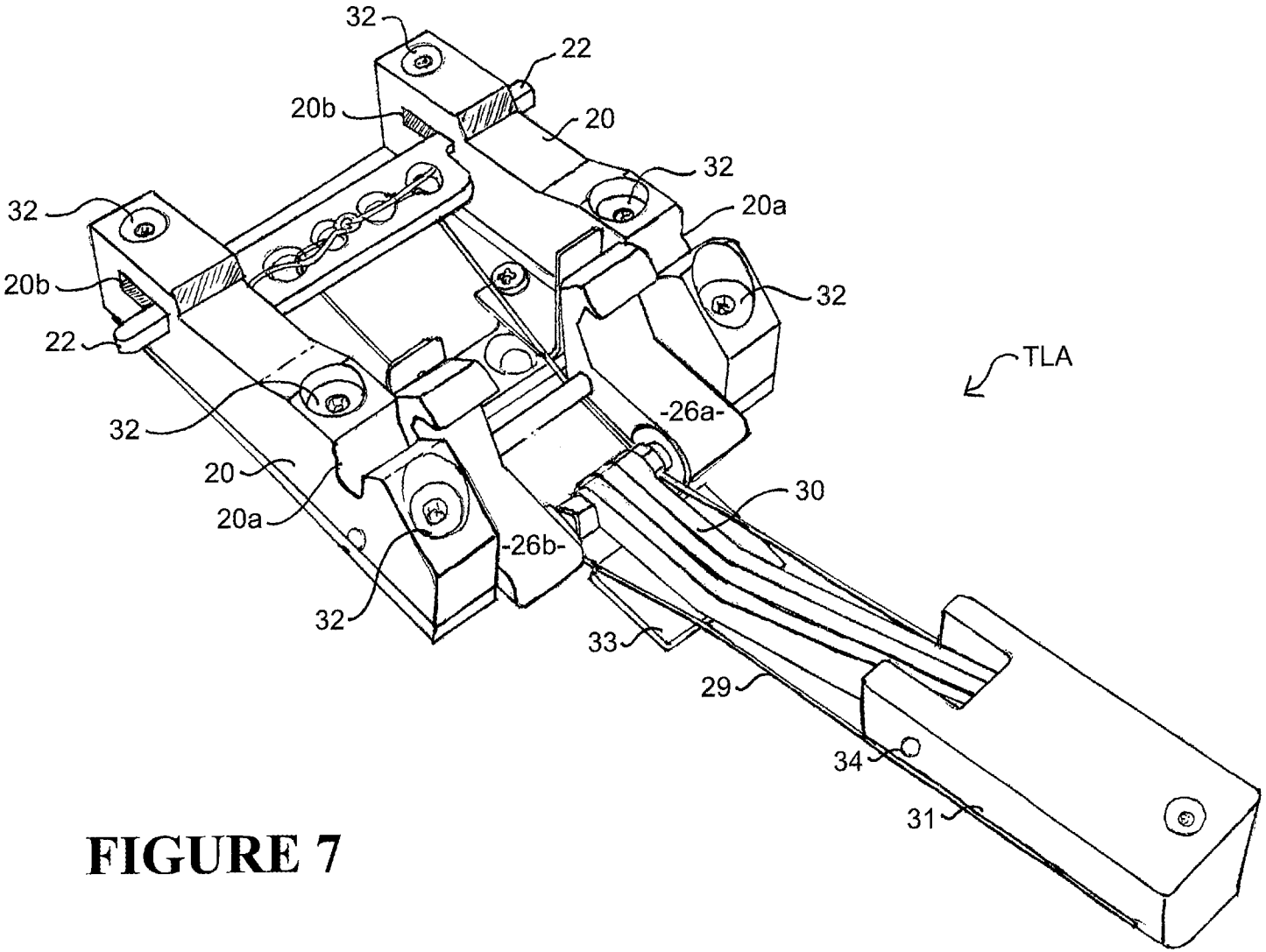
FIG. 7 is a perspective view of the toe latch assembly that connects to an item of sporting equipment and engages with the embodiment of FIGS. 1 to 6.
Figure 8:
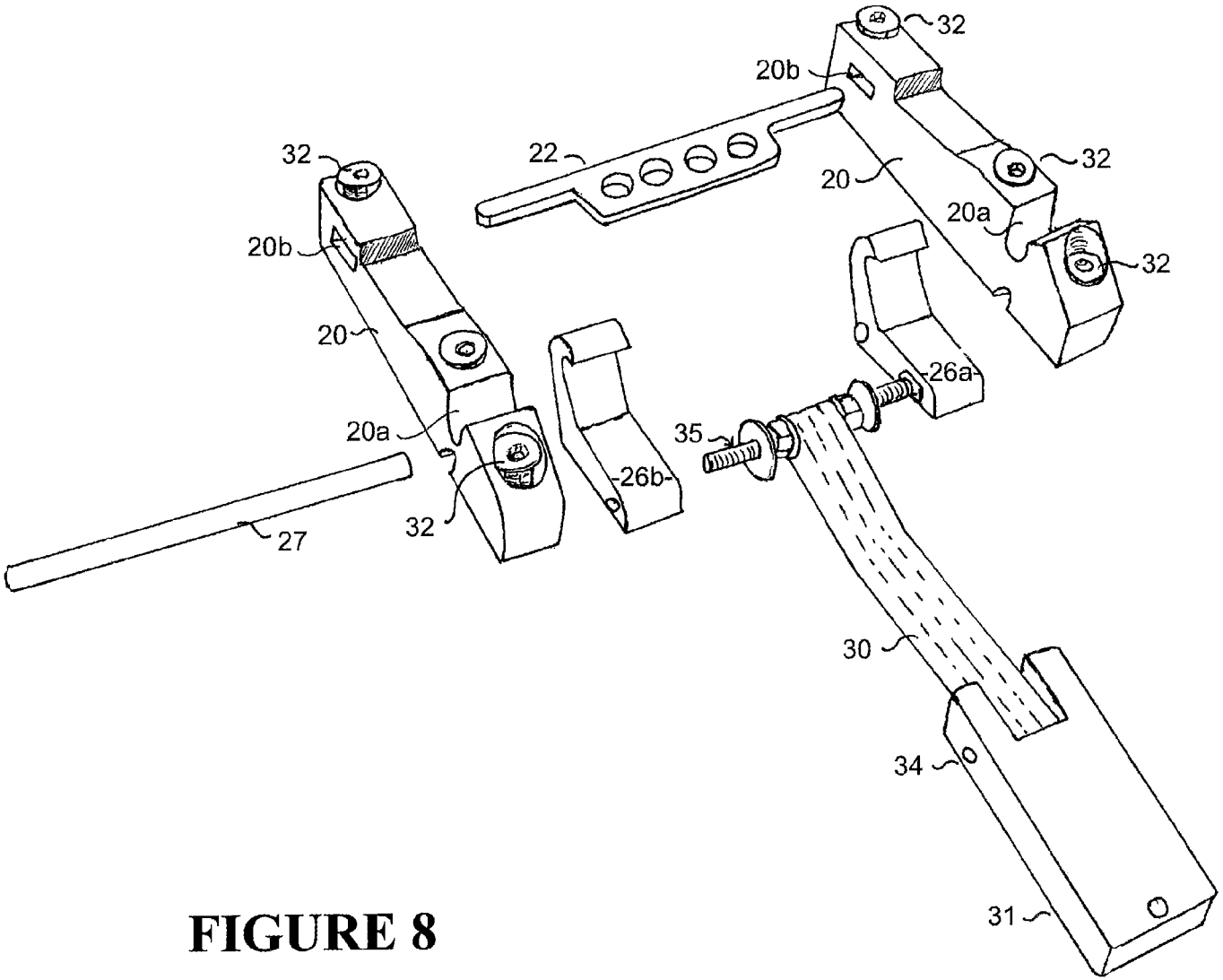
FIG. 8 is an exploded view of the toe latch assembly of FIG. 7.

FIGS. 7 and 8 show a preferred toe latch assembly TLA for attaching the exoskeleton E to a ski or other sports equipment via the forefoot portion 7*a* of the base 7. Latches 26*a*, 26*b* latch onto the pivot bar 24 when a user aligns the pivot bar 24 above the latches and applies a downward force. The pivot bar is then pivotally supported in recesses 20*a* in lateral and medial support members 20 which are connected to the base plate 23 which holds the toe latch assembly TLA together as one unit and attaches to the ski or sports equipment via fasteners 32. A plan view of the base plate is shown in FIG. 17. Alternatively the supports 20 could be attached directly to the sporting equipment.

To disengage the latches 26*a*, 26*b*, a primary lever 30 rests on a resilient latch support 33 and is operably connected to the latches 26*a*, 26*b* via an axle assembly 35. When a downward force is applied to the end of the primary lever 33, the latches 26*a*, 26*b* are rotated, freeing the pivot bar 24 that is attached to forefoot plate 8.

A preferred embodiment of the toe latch assembly TLA further comprises a sliding latch 22 that can engage with a second engagement feature on the base 7. In the embodiment shown in the figures, a second engagement feature is provided by a hook 8*e* in rear crampon points of the forefoot plate 8. A secondary lever 31 is connected to the anterior end of lever 30. The secondary lever pivots about an axle 34 at its posterior end, between a substantially horizontal position and an upright position (shown in FIG. 1). Wires 29 are attached to an anterior end of the secondary lever 31 and to the sliding latch 22, which is preferably spring loaded by a biasing means (not shown). In the substantially horizontal position shown in FIG.

7, the wires 29 are in tension and sliding latch 22 is pulled forward in the slots 20*b* in the supports 20 and clears the hooks 8*e* on the forefoot plate. By pivoting the secondary lever 31 to the upright position shown in FIG. 1, tension is released from the wires 29, and the spring loaded sliding latch 22 slides back in slot 20*b* engaging the hooks 8*e* to prevent pivoting of the forefoot plate 8, and therefore the foot about the pivot bar 24. When the sliding latch 22 is engaged with the hooks 8*e*, the configuration is suitable for downhill skiing.

When the secondary lever 31 is in the substantially horizontal position and the sliding latch 22 clears the hooks 8*e* in the forefoot plate, the forefoot plate will freely pivot relative to the item of sports equipment about pivot bar 24. This configuration is suitable for telemark skiing.

In an arrangement for telemark skiing, the design of the lever 30 and secondary lever 31 must provide space for the toe of the boot to rotate as shown in FIG. 2. Ideally the telemark pivot 24 is positioned under the user's big toe, and the levers must be positioned so there is ample space for the toe of the boots and any front crampon points 8*c*. This can be achieved by elevating pivot 21, keeping the secondary lever 31 forward of the required space, and keeping lever 30 close to the surface of the sporting equipment. The ability to position the pivot under the toe is an improvement over existing ski touring bindings that have the pivot forward of the toe as it allows for a more natural striding movement.

Alternatively or additionally, an engagement feature could be provided in the heel portion of the base 7, and a corresponding heel latch assembly fixed to the sports equipment. This latch assembly could be selectively engageable to engage the heel for downhill skiing or to disengage the heel for telemark skiing.

Where an embodiment of the invention is configured for telemark skiing and the base 7 includes crampon points, any front crampon points need to be angled and of a length so that they don't contact the board when the heel is lifted and the base assembly pivoted about pivot bar 24. In the embodiment shown, the heel crampon points rest directly on the ski or sporting equipment, but preferably a block or support is fixed to the surface of the ski or sporting equipment to support the underside of the heel plate 13 above the surface of the ski to prevent the crampon points from contacting the surface. The heel block may be a commercially available heel block and may include a heel bail for changing the boot angle for skiing up hill.

The base assembly 7 may alternatively have no crampon points and alternative features would be provided in the heel and/or forefoot plates for engaging with a toe latch assembly TLA, and optionally a heel latch assembly. For example, for inline skating, crampons are unlikely to be useful.

In an alternative embodiment, a known engagement mechanism or assembly may be used for attaching the exoskeleton E to the ski, and the exoskeleton adapted to engage with that engagement mechanism or assembly.

In an alternative embodiment, the base 7 could alternatively be an integral part of the item of sporting equipment. In such an embodiment, for example for use with roller skates, the rigid restraining braces would connect directly to the sporting equipment and there would be no toe latch assembly TLA.

Figure 4:
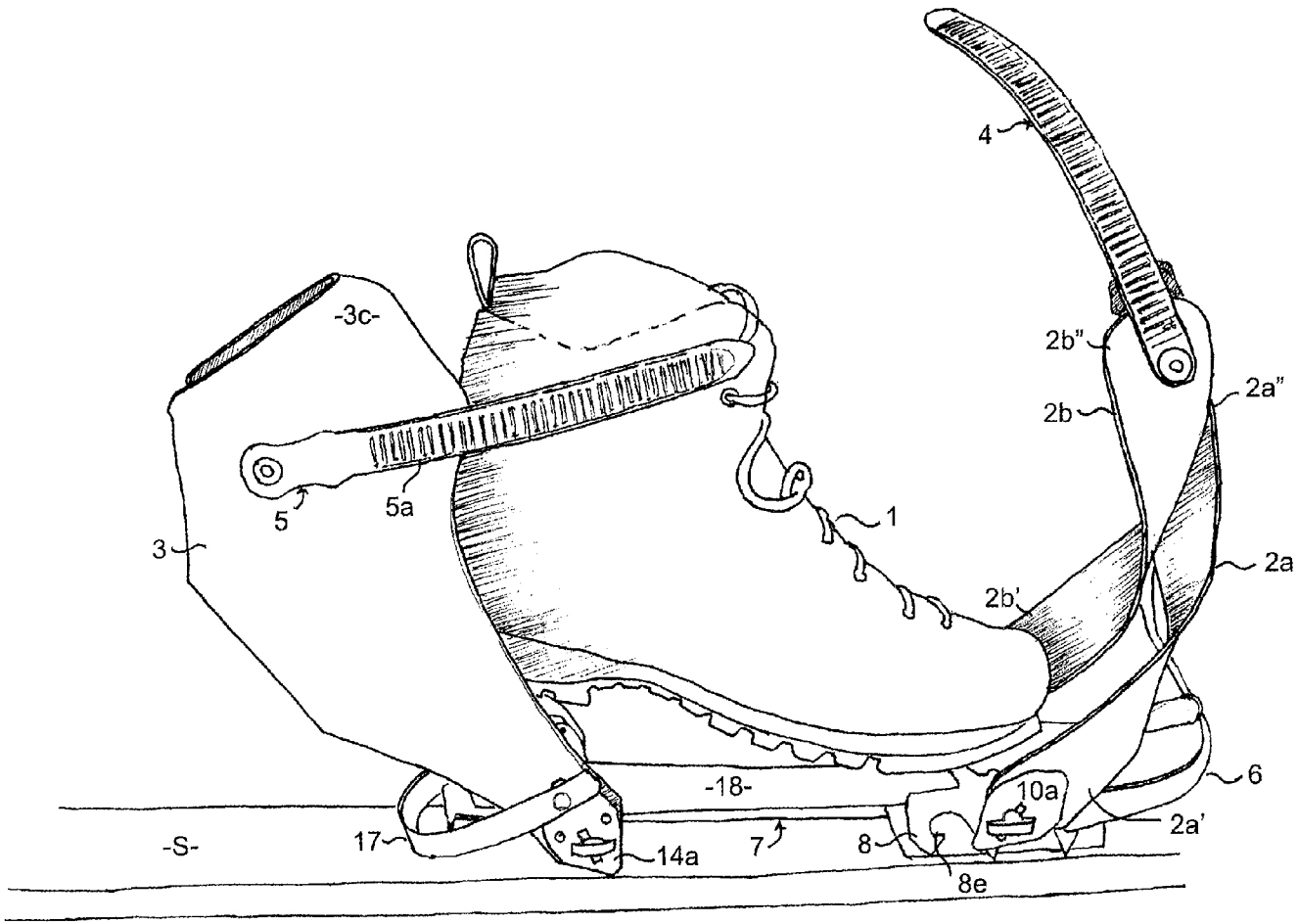
FIG. 4 is a side view of the embodiment of FIG. 1 with the exoskeleton in an expanded mode to allow the boot to be positioned in or removed from the exoskeleton.

To use the invention, a user secures his or her boot 1 in the open exoskeleton shown in FIG. 4 by placing the boot on the base assembly 7. The connected ankle cuff 3 and restraining braces 2*a*, 2*b* are then pivoted towards each other so they hug the boot. Ratchet connections 4 and 5 are tightened to secure the ankle cuff 3 around the ankle, and connect the restraining braces. Flexible retaining straps 6 and 17 are placed behind the heel and over the toe of the boot. The user can then connect the exoskeleton E to a toe latch assembly TLA connected to a ski or other piece of sports equipment by placing their foot over the toe latch assembly so the latches 26*a*, 26*b* are aligned with the pivot bar 24, then applying a downward force to engage the latch assembly.

To remove a boot, the exoskeleton E may be first disengaged from the toe latch assembly, TLA. In the embodiment shown, the latches 26*a*, 26*b* may be disengaged by applying downward pressure on primary lever 30. The user can then walk in the boot attached to the exoskeleton and crampon arrangement. The boot can be lifted out of the exoskeleton by releasing the ratchet straps 4, 5 and rotating the ankle cuff 3 and rigid restraining straps 2*a*, 2*b* away from the boot so the exoskeleton is in the open position of FIG. 4. To dismantle the exoskeleton for compact storage, the ankle cuff 3 and rigid restraining straps 2*a*, 2*b* can be further rotated so the slots in the metal connector plates 14*a*, 14*b*, 10*a*, 10*b* align with the rectangular heads on the forefoot brace connectors 11 and heel connectors 15, and then can be slid off the end of the connectors 11, 15.

Embodiments of the invention have been described by way of example only and modifications may be made thereto without departing from the scope of the invention without departing from the scope of the accompanying claims.

The invention claimed is:

1. An exoskeleton for connecting an item of footwear to sporting equipment, the exoskeleton comprising:

an underfoot base;

an ankle cuff connected to a heel portion of the underfoot base;

a first restraining brace having an anterior end connected to the medial side of a forefoot portion of the underfoot base and a posterior end positioned adjacent the lateral side of the ankle cuff, and extending rearwardly and diagonally at least to the lateral side of the ankle cuff to provide lateral support to the ankle cuff;

a second restraining brace having an anterior end connected to the lateral side of the forefoot portion of the underfoot base and a posterior end positioned adjacent the medial side of the ankle cuff, and extending rearwardly and diagonally at least to the medial side of the ankle cuff to provide medial support to the ankle cuff; and a restraining brace connector configured to extend behind the ankle cuff to operatively and detachably connect the posterior end of the first restraining brace to the posterior end of the second restraining brace;

wherein the first and second restraining braces are configured such that when an item of footwear is enclosed by the exoskeleton, the restraining braces extend over and support a portion of the item of footwear.

2. An exoskeleton as claimed in claim 1, wherein the first and second restraining braces are sufficiently stiff to hold their shape in the absence of an external force.

3. An exoskeleton as claimed in claim 2, wherein the first and second restraining braces are substantially rigid.

4. An exoskeleton as claimed in claim 1, wherein the posterior end of the first restraining brace and the posterior end of the second restraining brace are operatively and detachably connected to the ankle cuff.

5. An exoskeleton as claimed in claim 1, wherein the first and second restraining braces are pivotally connected to the underfoot base.

6. An exoskeleton as claimed in claim 1, wherein the ankle cuff is pivotally connected to the underfoot base.

7. An exoskeleton as claimed in claim 1, further comprising an adjustable cuff fastener connected to the ankle cuff, for securing the ankle cuff around the ankle of an item of footwear or around a user's lower leg enclosed in the exoskeleton.

8. An exoskeleton as claimed claim 7 wherein the adjustable cuff fastener is a ratchet strap arrangement.

9. An exoskeleton as claimed in claim 1, wherein the restraining brace connector is adjustable.

10. An exoskeleton as claimed in claim 9, wherein the restraining brace connector is a ratchet strap arrangement.

11. An exoskeleton as claimed in claim 1, wherein the first and second restraining braces are removably connected to the underfoot base.

12. An exoskeleton as claimed in claim 1, wherein the ankle cuff is removably connected to the underfoot base.

13. An exoskeleton as claimed in claim 1, wherein the underfoot base has the form of a crampon.

14. An exoskeleton as claimed in claim 13, comprising at least one crampon point at a periphery of the heel portion of the underfoot base.

15. An exoskeleton as claimed in claim 13, comprising at least four crampon points disposed at the forefoot portion of the underfoot base assembly.

16. An exoskeleton as claimed in claim 13, further comprising connectors fixed to ends of the ankle cuff and/or the restraining braces, for connecting the ankle cuff and/or the restraining braces to the underfoot base.

17. An exoskeleton as claimed in claim 16, wherein the connectors are plates which form crampon points.

18. An exoskeleton as claimed in claim 2, wherein the restraining braces comprise carbon fibre.

19. An exoskeleton as claimed in claim 2, wherein the restraining braces comprise a stiff or rigid material and a flexible material arranged so that if the stiff or rigid material undergoes a failure, the flexible material will keep the fractured parts connected.

20. An exoskeleton as claimed in claim 1, wherein the ankle cuff comprises a relatively flexible posterior portion and relatively stiff lateral and medial portions.

21. An exoskeleton as claimed in claim 1, wherein the heel portion and the forefoot portion of the underfoot base are substantially rigid and are connected by a relatively flexible mid-foot portion to allow vertical motion of the heel portion relative to the forefoot portion.

22. An exoskeleton as claimed in claim 1, wherein the ankle cuff has a rear heel cut-out.

23. An exoskeleton as claimed in claim 1, further comprising a flexible heel retaining strap and a flexible toe retaining strap.

24. An exoskeleton as claimed in claim 1, further comprising an engagement feature for connecting the exoskeleton to an item of sporting equipment.

25. A footwear attachment system for attaching an item of footwear to an item of sporting equipment, the system comprising:

an exoskeleton as claimed in claim 24; and a toe latch assembly attached to an item of sporting equipment, the toe latch assembly comprising at least one latch suitable for engaging the engagement feature on the exoskeleton.

26. A footwear attachment system as claimed in claim 25, whereby when the latch and engagement feature are engaged, the engagement forms a pivot for the exoskeleton so that the heel portion of the underfoot base is movable up and down with respect to the item of sporting equipment.

27. A footwear attachment system as claimed in claim 26, further comprising a secondary engagement feature on the forefoot portion of the underfoot base and a complementary secondary engagement feature on the toe latch assembly, wherein the complementary secondary engagement features are selectively engageable with each other to prevent the exoskeleton pivoting relative to the toe latch assembly.

28. A footwear attachment system as claimed in claim 27, wherein the underfoot base has the form of a crampon and the secondary engagement feature on the forefoot portion of the underfoot base is provided in a crampon point.

29. A footwear attachment system for attaching an item of footwear to an item of sporting equipment, the system comprising an exoskeleton, a toe latch assembly attached to an item of sporting equipment, and a heel latch assembly attached to the item of sporting equipment, the exoskeleton comprising:

an underfoot base;

an ankle cuff connected to a heel portion of the underfoot base;

a first restraining brace having an anterior end connected to the medial side of a forefoot portion of the underfoot base, and extending rearwardly and diagonally at least to the lateral side of the ankle cuff to provide lateral support to the ankle cuff;

a second restraining brace having an anterior end connected to the lateral side of the forefoot portion of the underfoot base, and extending rearwardly and diagonally at least to the medial side of the ankle cuff to provide medial support to the ankle cuff, the first and second restraining braces being configured such that when an item of footwear is enclosed by the exoskeleton, the restraining braces extend over and support a portion of the item of footwear; and an engagement feature for connecting the exoskeleton to an item of sporting equipment;

wherein the toe latch assembly comprises at least one latch suitable for engaging the engagement feature on the exoskeleton, and wherein the heel latch assembly is selectively engageable with a heel engagement feature on the heel portion of the underfoot base.

30. A footwear attachment system for attaching an item of footwear to an item of sporting equipment, the system comprising an exoskeleton and a toe latch assembly attached to an item of sporting equipment, the exoskeleton comprising:

an underfoot base;

an ankle cuff connected to a heel portion of the underfoot base;

a first restraining brace having an anterior end connected to the medial side of a forefoot portion of the underfoot base, and extending rearwardly and diagonally at least to the lateral side of the ankle cuff to provide lateral support to the ankle cuff;

a second restraining brace having an anterior end connected to the lateral side of the forefoot portion of the underfoot base, and extending rearwardly and diagonally at least to the medial side of the ankle cuff to provide medial support to the ankle cuff, the first and second restraining braces being configured such that when an item of footwear is enclosed by the exoskeleton, the restraining braces extend over and support a portion of the item of footwear; and an engagement feature for connecting the exoskeleton to an item of sporting equipment;

wherein the toe latch assembly comprises at least one latch suitable for engaging the engagement feature on the exoskeleton and wherein when the toe latch and engagement feature are engaged, the engagement forms a pivot for the exoskeleton so that the heel portion of the underfoot base is movable up and down with respect to the item of sporting equipment, and the pivot is positioned so that when a user's foot is secured in the system the pivot is under the user's big toe.

* * * * *